US011000062B2

(12) United States Patent
Uthurry

(10) Patent No.: US 11,000,062 B2
(45) Date of Patent: May 11, 2021

(54) PLASMA TREATMENT OF FILTRATION MEDIA FOR SMOKING ARTICLES

(71) Applicant: PHILIP MORRIS PRODUCTS S.A., Neuchâtel (CH)

(72) Inventor: Jérôme Uthurry, Neuchâtel (CH)

(73) Assignee: Philip Morris Products S.A., Neuchâtel (CH)

( * ) Notice: Subject to any disclaimer, the term of this patent is extended or adjusted under 35 U.S.C. 154(b) by 180 days.

(21) Appl. No.: 15/771,573

(22) PCT Filed: Oct. 24, 2016

(86) PCT No.: PCT/IB2016/056385

§ 371 (c)(1),
(2) Date: Apr. 27, 2018

(87) PCT Pub. No.: WO2017/072648

PCT Pub. Date: May 4, 2017

(65) Prior Publication Data

US 2018/0310612 A1 Nov. 1, 2018

(30) Foreign Application Priority Data

Oct. 29, 2015 (EP) ..... 15192047

(51) Int. Cl.
*A24D 3/06* (2006.01)
*A24D 3/10* (2006.01)
*A24D 3/14* (2006.01)

(52) U.S. Cl.
CPC ..... *A24D 3/061* (2013.01); *A24D 3/10* (2013.01); *A24D 3/14* (2013.01)

(58) Field of Classification Search
CPC ..... A24D 3/061
See application file for complete search history.

(56) References Cited

U.S. PATENT DOCUMENTS

2004/0261807 A1 12/2004 Dube et al.
2013/0104918 A1* 5/2013 Serguei ..... A24D 3/067 131/331

(Continued)

FOREIGN PATENT DOCUMENTS

EP 0513603 B1 12/1998
EP 1906775 B1 9/2008

(Continued)

OTHER PUBLICATIONS

Mittal and Amer Chem Soc, *Contact Angle, Wettability and Adhesion*. vol. 2, Utrecht, The Netherlands: VSP, 1993. Cover page, title page and table of contents: 9 pgs.

(Continued)

*Primary Examiner* — Eric Yaary
*Assistant Examiner* — Jennifer A Kessie
(74) *Attorney, Agent, or Firm* — Mueting Raasch Group

(57) ABSTRACT

A smoking article includes smokable material, a filter downstream of the smokable material, and a breakable capsule (80). The filter is plasma treated or has an increased surface energy relative to standard filter material. The breakable capsule (80) includes a core surrounded by a frangible shell. The core contains a liquid composition comprising a sensory-enhancing agent. The breakable capsule is positioned to cause the liquid composition to contact the filter material (32) when the shell is ruptured.

12 Claims, 3 Drawing Sheets

(56) References Cited

U.S. PATENT DOCUMENTS

| | | | | |
|---|---|---|---|---|
| 2013/0115452 | A1 | 5/2013 | Bundren et al. | |
| 2015/0201674 | A1* | 7/2015 | Dooly | B65B 5/06 53/432 |

FOREIGN PATENT DOCUMENTS

| | | | |
|---|---|---|---|
| JP | 1994-502068 | A | 3/1994 |
| JP | WO 2011-519268 | A | 7/2011 |
| JP | 2014-532435 | A | 12/2014 |
| JP | 2015-503038 | A | 1/2015 |
| WO | WO 2007/010407 | A2 | 1/2007 |
| WO | WO 2009/121698 | A1 | 10/2009 |
| WO | WO 2013/067503 | A1 | 7/2011 |
| WO | WO 2013/068304 | A1 | 5/2013 |
| WO | WO 2015/091792 | A1 | 6/2015 |

OTHER PUBLICATIONS

J.M. van Hazendonk et al., "A simple experimental method for the measurement of the surface tension of cellulosic fibers and its relation with chemical composition," *Colloids and Surfaces A: Physiochemical and Engineering Aspects*, Dec. 13, 1993;81:251-261.

Extended European Search Report for corresponding application EP 15192047.7, dated May 2, 2016, by the European Patent Office; 9 pgs.

International Search Report and Written Opinion, for PCT/IB2016/056385, issued by the European Patent Office, dated Jan. 27, 2017; 12 pgs.

International Preliminary Report on Patentability, for PCT/IB2016/056385, issued by the European Patent Office, dated Oct. 6, 2017; 12 pgs.

Zisman, W.A., "Relation of the Equilibrium Contact Angle to Liquid and Solid Constitution," in *Contact Angle, Wettability and Adhesion*: Fowkes F; Advances in Chemistry, American Chemical Society, Washington D.C., 1964: pp. 1-51.

Japanese Office Action issued for JP 2018-520186, issued by the Japanese Patent Office, dated Oct. 29, 2020; 10 pgs. including English translation.

* cited by examiner

PLASMA TREATMENT OF FILTRATION MEDIA FOR SMOKING ARTICLES

This application is the § 371 U.S. National Stage of International Application No. PCT/IB2016/056385, filed 24 Oct. 2016, which claims the benefit of European Application No. 15192047.7, filed 29 Oct. 2015, disclosures of which are incorporated by reference herein in their entireties.

This disclosure relates to smoking articles that include filter material and a component configured to release a liquid composition containing a sensory enhancing agent. The liquid composition wets the filter material and the sensory enhancing agent is entrained in mainstream smoke that passes through the filter material. The filter material may be treated to increase the rate or amount of uptake of sensory enhancing agent in mainstream smoke.

Smoking articles, such as cigarettes, can include flavour capsules configured to release flavourant into mainstream smoke. Examples of flavour capsules include crushable capsules that include a crushable shell defining an interior volume in which a flavourant and liquid carrier are disposed. Upon rupture of the capsule, for example by crushing the shell, the flavourant and liquid carrier are released, and the flavourant can be carried in mainstream smoke to a smoker's mouth to enhance the flavour of the smoke.

Crushable flavour capsules are often disposed in a mouthpiece of the smoking article and are often placed in contact with filter material. When the shell of the capsule is crushed, the liquid carrier and flavourant can wet the filter material. Mainstream smoke that passes through or around the filter material can entrain the flavourant.

Crushable capsules deliver flavour on demand. However, it has been found that the amount of flavourant released from crushable capsules carried in mainstream smoke increases over time. For example, it has been observed that menthol in smoke levels increase over time after a flavour capsule containing the menthol is crushed under standard ISO smoking procedures. For example, the amount of menthol in smoke five minutes after crushing of the capsule has been found to be greater than the amount of menthol is smoke two minutes after the capsule is crushed.

One object of the present invention is to manufacture a smoking article having a component containing a sensory enhancing agent, where, upon breaking the component, distribution of the sensory enhancing agent in the filter is increased relative to currently available capsule-containing smoking articles. Preferably, the increased distribution results in an increased rate, amount, or rate and amount of uptake of the sensory enhancing agent in mainstream smoke relative to currently available capsule-containing smoking articles. Other objects of the present invention will be evident to those of skill in the art upon reading and understanding the present disclosure, which includes the claims that follow and the accompanying drawings.

In one aspect of the present invention, surface energy of filter material is enhanced to increase wettability of the filtration material. Enhanced wettability can result in broader distribution of liquid carrier and sensory enhancing agent, which can allow for greater or more rapid transfer of sensory enhancing agent into mainstream smoke. Surface energy of the filtration material can be increased by plasma treatment. In preferred embodiments, individual fibres or tow bands of filtration material are treated.

In one aspect of the present invention, a smoking article includes smokable material, a filter downstream of the smokable material, and a component configured to release a liquid composition containing a sensory enhancing agent, such as a breakable capsule. The filter comprises plasma treated filter material. The breakable capsule includes a core surrounded by a frangible shell. The core contains a liquid composition comprising a sensory-enhancing agent. The breakable capsule is positioned to cause the liquid composition to contact the filter material when the shell is ruptured.

In another aspect of the present invention, a smoking article includes smokable material, filter material downstream of the smokable material, and a breakable capsule that includes a core surrounded by a frangible shell. The core contains a liquid composition comprising a sensory-enhancing agent. The breakable capsule is positioned to cause the liquid composition to contact the filter material when the shell is ruptured. The filter material has a surface energy at least 10% greater than standard filter material. In one embodiment, the standard filter material can be provided and tested in the form of a non-plasma treated cellulose acetate filter rod which has the following properties: 108 mm length (typically used for making 4 filters of 27 mm each, a resistance to draw at 370 mm water, 7.6 mm diameter and 2.7Y35,000 (Y shaped cross-section, a denier per filament of 2.7 and a total denier of 35,000). In another embodiment, standard filter material can be provided and tested in the form of a non-plasma treated fiber or a tow band of polylactic acid (PLA) for forming a filter rod which has the following properties: 108 mm length (typically used for making 4 filters of 27 mm each, a resistance to draw at 370 mm water, 7.6 mm diameter and 3.2Y50,000 (Y shaped cross-section, a denier per filament of 3.2 and a total denier of 50,000).

Smoking articles according to preferred embodiments of the present invention deliver cumulative amounts of one or more sensory enhancing agents in smoke that are higher than cumulative amounts delivered in smoke of smoking articles having untreated or standard filter material. For example, when a smoking article according to the present invention is subjected to routine testing by analytical cigarette-smoking machine, for example in accordance with ISO 3308 (2012), the cumulative amount of sensory enhancing agent delivered in smoke within two minutes of breaking the capsule is at least 10% more than the cumulative amount of sensory enhancing agent of a substantially similar smoking article having the untreated or standard filter material.

In yet another aspect of the present invention, a method for forming a smoking article for enhanced delivery of a sensory-enhancing agent from a capsule includes plasma treating filter material. The method further includes incorporating the plasma-treated filter material in a mouthpiece of the smoking article. The method also includes incorporating in the mouthpiece the capsule. The capsule includes a core surrounded by a frangible shell. The core contains a liquid composition comprising the sensory-enhancing agent. The capsule is incorporated in the mouthpiece such that upon rupture of the shell the liquid composition contacts the plasma-treated filter material. The method further includes incorporating the mouthpiece into a smoking article.

Various aspects of the present invention may have one or more advantages relative to currently available or previously described smoking articles that have a sensory enhancing capsule, which upon breaking, releases a sensory enhancing agent such that the sensory enhancing agent contacts filtration material. For example, the smoking article described herein may be perceived as providing better on-demand delivery of the sensory enhancing agent because the rate or amount of the sensory enhancing agent delivered is increased. In addition, increased surface energy of filter material may allow for better distribution of plasticizer. As such, less plasticizer may be used or increased filter hardness may be achieved with a given amount of plasticizer. These and other advantages of various aspects of the present invention will be evident to those of skill in the art upon reading and understanding the present disclosure.

The present invention is applicable to any suitable smoking article that includes a filter and a capsule containing a sensory enhancing agent, where upon rupture of the capsule the sensory enhancing agent contacts filter material.

Examples of smoking articles that comprise a filter and a capsule include cigarettes, cigars, cigarillos and other articles in which a smokable material, such as a tobacco, is lit and combusted to produce smoke. Other examples of smoking articles that can include a filter and a capsule of the present invention include articles in which smokable material is not combusted, such as but not limited to smoking articles that heat a smoking composition directly or indirectly, or smoking articles that use air flow or a chemical reaction, with or without a heat source, to deliver nicotine or other materials from the smokable material.

As used herein, the term "smoke" is used to describe an aerosol produced by a smoking article. An aerosol produced by a smoking article may be, for example, smoke produced by combustible smoking articles, such as cigarettes, or aerosols produced by non-combustible smoking articles, such as heated smoking articles or non-heated smoking articles.

In some preferred embodiments, a smoking article of the present invention is a smoking article in which smokable material is combusted. Combustible smoking articles, such as cigarettes, typically have shredded tobacco (usually in cut filler form) surrounded by a paper wrapper forming a tobacco rod. A cigarette is employed by a smoker by lighting one end of the cigarette and burning the tobacco rod. The smoker then receives mainstream smoke by drawing on the opposite end or mouth end of the cigarette, which typically contains a filter. A filter of a combustible smoking article, such as a cigarette, can be positioned to entrap some constituents of mainstream smoke before the mainstream smoke is delivered to a smoker.

In other preferred embodiments, a smoking article includes an aerosol generating substrate that is not combusted. Preferably, non-combustible smoking articles of the present invention include articles in which a nicotine-containing aerosol is generated from a tobacco material, tobacco extract, or other nicotine source, without combustion, and in some cases without heating, for example through a chemical reaction. Heated smoking articles preferably include, for example, smoking articles in which an aerosol is generated by electrical heating or by the transfer of heat from a combustible fuel element or heat source to an aerosol generating substrate. During smoking, volatile compounds are released from the aerosol generating substrate by heat transfer from the heat source and entrained in air drawn through the smoking article. As the released compounds cool they condense to form an aerosol that is inhaled by the consumer. Non-combustible smoking articles, whether heated or non-heated, can include a filter positioned to adsorb smoke constituents before the smoke is delivered to a user.

Filters in smoking articles, whether combustible or non-combustible, can be disposed downstream of the smokable material. The term "downstream" refers to relative positions of elements of the smoking article described in relation to the direction of mainstream smoke as it is drawn from a smokable material and into a user's mouth.

A component configured to release a liquid composition containing one or more sensory enhancing agent, such as breakable capsules are positioned in a smoking article of the present inventions such that when the component is configured to release, such as when it is broken, the one or more sensory enhancing agents or a fluid composition containing the one or more sensory enhancing agents contact the filter material. One or more such components, such as breakable capsules, can be embedded within filter material, placed adjacent to filter material, or otherwise positioned such that upon breaking the one or more sensory enhancing agents or a fluid composition containing the one or more sensory enhancing agents is released and contact the surrounding filter material.

In preferred embodiments, a smoking article includes a mouthpiece containing a filter and a breakable capsule. The mouthpiece, in some embodiments, can additionally include a plug wrap disposed about the filter. The smoking article can, in some preferred embodiments, include a tipping wrapper that secures the mouthpiece to a rod of smokable material.

Any suitable breakable capsule may be employed in a smoking article as described herein. A breakable capsule includes a core containing one or more sensory enhancing agents, such as a flavourants or other sensory agents, and includes a shell surrounding the core. Contents of the core can be released upon breaking the shell.

A breakable capsule may have any suitable shell. For example, the shell of a breakable capsule can be a polysaccharide based material, such as pectin or alginate; gelatin; a paraffin wax; a polyvinyl alcohol; vinyl acetate; algin; or any other suitable material or combinations thereof. It can be appreciated that a multitude of processes exist for manufacturing breakable capsules. Accordingly, the capsules can be of varying size and shape, differing resistance to kinetic or thermal forces to break or rupture the capsule, and can include alternative capsule compositions and capsule constituents.

Any suitable sensory enhancing agent may be included in the core of a breakable capsule. Examples of suitable sensory enhancing agents include flavourants and sensation agents. Suitable flavourants include aromatic or fragrance molecule as conventionally used in the formulation of flavouring or fragrance compositions. Preferably, the flavourant is an aromatic, terpenic or sesquiterpenic hydrocarbon. The flavourant may be an essential oil, alcohol, aldehyde, phenolic molecule, carboxylic acid in their various forms, aromatic acetal and ether, nitrogenous heterocycle, ketone, sulfide, disulfide and mercaptan which may be aromatic or non-aromatic. Examples of flavouring agents include natural or synthetic aromas or fragrances. Examples of suitable fragrances are fruity, confectionery, floral, sweet, woody fragrances. Examples of suitable aromas are coconut, vanilla, coffee, chocolate, cinnamon, mint, or roasted or toasted aromas.

Examples of suitable sensory agents include freshening agents, cooling agents, or hot effect agents, which respectively provide a freshening or cooling effect or a hot effect in the mouth. Suitable freshening agents may be, but are not limited to, menthyl succinate and derivatives thereof. A suitable hot effect agent may be, but is not limited to, vanillyl ethyl ether.

In one preferred embodiment, a breakable capsule contains menthol as a sensory enhancing agent.

The concentration of sensory enhancing agent in a breakable capsule can be adjusted or modified to provide a desired amount of the sensory enhancing agent.

The core or the shell can include one or more sweeteners, which may be provided in the form of a solution or suspension in ethanol. Examples of suitable sweeteners may be, but is not limited to, sorbitol, aspartame, saccharine, neohesperidin dihydrochalcone (NHDC), sucralose, acesulfame, neotame, or the like.

The core may comprise one or more fillers as used in aromatic emulsions such as, for example, dammar gum, wood resins of the ester gum type, sucrose acetate isobutyrate (SAIB) or brominated vegetable oils. These agents may serve to adjust the density of the fluid core.

The core comprises the sensory enhancing agent and a liquid carrier. Preferably, the liquid carrier comprises one or more lipids. For example, the core may comprise medium chain triglycerides, a vegetable oil, or a mixture thereof. Preferably the core comprises coconut oil.

Examples of breakable capsules that may be used in smoking articles of the present invention include mechanically breakable capsules, such as crushable capsules; heat frangible capsules; microcapsules with diameters of 0.3 mm to 1.0 mm; or macrocapsules with diameters of 1.0 mm to 7.0 mm; and the like. Preferably, the breakable capsules are crushable capsules. As used herein, a crushable capsule is a capsule having a crush strength from about 0.01 kp to about 5 kp, preferably from about 0.5 kp to about 2.5 kp, more preferably from about 0.6 kp to about 2 kp, even more preferably from about 0.8 kp to about 1.2 kp.

The crush strength of the capsule can be measured by continuously applying a load vertically onto one capsule until rupture. The crush strength of the capsules can be measured by using a LLOYD-CHATILLON Digital Force Gauge, Model DFIS 50, having a capacity of 25 Kg, a resolution of 0.02 Kg, and an accuracy of +/−0.15%. The force gauge can be attached to a stand; the capsule can be positioned in the middle of a plate that is moved up with a manual thread screw device. Pressure can then be applied manually. The gauge records the maximum force applied at the very moment of the rupture of the capsule (measured in, for example, Kg or in Lb). Rupture of the capsule results in the release of contents of the core.

Additional methods for characterizing capsules include crush force which is the maximum compressive force measured in, for example, Newtons that a capsule can withstand before breakage; and distance at breakage which is the change in dimension of the capsule due to compression, i.e., deformation, at breakage. It can also be expressed for example by the ratio between a dimension of the capsule (e.g., the capsule diameter) and the dimension of the capsule, measured in the direction of the compression force, when it is compressed to the point of breakage. The compression is generally applied toward the floor by the compression plates of an automatic or manual compression testing machine. Such machines are well known in the art and commercially available.

Preferably, a capsule has a crush force value of about 10.0 N to about 20.0 N, more preferably from about 11 N to about 18 N, and even more preferably in the range of about 12.0 N to about 16.0 N.

In some embodiments, crushable capsules are capsules as described in published European patent application EP1906775A2, entitled "Smoking device incorporating a breakable capsule, breakable capsule and process for manufacturing said capsule," or as disclosed in US2004/0261807.

Preferably, a crushable capsule incorporates selected hydrocolloids in the outer shell of the capsule, in a coating of the outer shell by a moisture barrier layer or in both the outer shell and in the coating. For example, the shell, coating or shell and coating may independently include one or more hydrocolloid selected from gellan gum, agar, alginates, carrageenans, pectins, arabic gum, ghatti gum, pullulan gum, mannan gum or modified starch, alone or as a mixture thereof or in combination with gelatin.

The shell may contain any suitable amount of the one or more hydrocolloids, such as from about 1.5% w/w to about 95% w/w, preferably from about 4% w/w to about 75% w/w, and even more preferably from about 20% w/w to about 50% w/w of the total dry weight of the shell.

The shell may further include one or more fillers. As used herein a "filler" is any suitable material that can increase the percentage of dry material in the shell. Increasing the dry material amount in a shell can result in solidifying the shell, and in making the shell physically more resistant to deformation. Preferably, the filler is selected from the group comprising starch derivatives such as dextrin, maltodextrin, cyclodextrin (alpha, beta or gamma), or cellulose derivatives such as hydroxypropylmethylcellulose (HPMC), hydroxypropylcellulose (HPC), methylcellulose (MC), carboxymethylcellulose (CMC), polyvinyl alcohol, polyols or mixture thereof. Dextrin is a preferred filler. The amount of filler in the shell is generally 98.5% or less, preferably from about 25% to about 95%, more preferably from about 40% to about 80%, and even more preferably from about 50% to about 60% by weight of the total dry weight of the shell.

Preferably, the shell of the capsule comprises gelatin. The shell preferably includes 50% or more, 60% or more, 70% or more, 80% or more, or 90% or more gelatin by weight, excluding the weight of any filler that may be present in the shell.

The shell of a crushable capsule may be of any suitable thickness. In some embodiments, the shell thickness of the capsule is from about 10 microns to about 500 microns, preferably from about 30 microns to about 150 microns, more preferably from about 50 microns to about 80 microns.

A capsule for incorporation into a smoking article in accordance with the teachings presented herein may have any suitable ratio of the weight of the shell to the weight of the capsule. For example, the ratio of the weight of the shell to the weight of the shell can be from about 8% to about 50%, preferably from about 8% to about 20%, more preferably from about 8% to about 15%, by weight/total weight of the capsule.

The core of the capsule included within the smoking article of the invention may include a mixture of materials or products which are lipophilic or partially soluble in ethanol, or of molecules formulated as oil/water/oil emulsions.

The core may represent any suitable weight percent of the capsule. For example, the core of a breakable capsule represents by weight from about 50% to about 92% of the capsule, preferably from about 80% to about 92% by weight, more preferably from about 85% to about 92% by weight.

The core of the capsule may include one or more lipophilic solvents conventionally used in the food, pharmaceutical or cosmetic industries. In preferred embodiments, these lipophilic solvents may be triglycerides, especially medium chain triglycerides, and in particular triglycerides of caprylic and capric acid, or mixtures of triglycerides such as vegetable oil, olive oil, sunflower oil, corn oil, groundnut oil, grape seed oil, wheat germ oil, mineral oils and silicone oils. The core may contain any suitable amount of lipophilic solvent. For example, the amount of lipophilic solvent in the core of a capsule is of the order of 0.01 to 90%, preferably 25 to 75% by weight of the total weight of the capsule.

The core may also comprise one or more sensory enhancing agents, fillers, sweeteners, or combinations thereof as described above.

A capsule may have any suitable total weight. For example, the total weight of the capsule can be from about 5 mg to about 60 mg, preferably from about 10 mg to about 50 mg, more preferably from about 20 mg to about 40 mg.

A capsule for incorporation into a smoking article in accordance with the teachings presented herein may have any suitable outer diametric dimension. In some embodiments, the outer diameter of the capsule is in the range of about 0.5 mm to about 8 mm, preferably from about 1 mm to about 5 mm, more preferably from about 1.5 mm to about 4.5 mm, and even more preferably from about 2.5 mm to about 4 mm.

In some embodiments, a capsule for use in a smoking article of the invention is a seamless capsule obtained through a co-extrusion process. The co-extrusion process can be a synchronous extrusion of two liquids: an external and hydrophilic liquid phase, and an internal and lipophilic liquid phase. Preferably, the co-extrusion process includes three main stages: compound drop formation, shell solidification and capsule collection. The compound drop is a sphere of the liquid fill phase inside the shell phase. The liquid fill phase constitutes the core. The shell phase constitutes the shell. The capsules of the invention may be produced by any suitable co-extrusion process, such as described in EP1906775A2 or EP 513603.

One or more breakable capsules are incorporated into a smoking article in sufficiently close proximity to filter material such that contents of the cores of the capsules will wet the filter material after the capsules are broken.

A filter of a smoking article of the present invention can include any suitable filter material. Examples of suitable filter material include cellulose esters such as cellulose acetate, polylactic acid (PLA), cellulosic material, polypropylene, cotton, flax, hemp, or any degradable filtration media, or a combination or blend of any two or more of filter materials. In preferred embodiments, the filter material includes polymeric filter material such as polylactic acid, cellulose esters, and blends thereof. Preferably, the filter material includes a cellulose ester. Examples of cellulose esters that can be used to form filter material include cellulose acetates, cellulose propionates and cellulose butyrates with varying degrees of substitution, as well as mixed esters thereof. Examples of such mixed esters include cellulose acetate propionate, cellulose acetate butyrate, and cellulose acetate propionate butyrate. Preferably, the filter material comprises cellulose acetate.

The filter material preferably includes fibers. Preferably, the filter material comprises a fibrous polymeric filter material. In preferred embodiments, the filter material comprises cellulose acetate fibers or polylactic acid fibers. The characteristics of the filter material can be in the ranges of 1.5 to 8.0 denier per filament, Y-cross section and 15,000 to 50,000 total denier.

The filter material can be treated to enhance wettability of the material. Wetting refers to the phenomenon of how a liquid deposited on a solid substrate spreads out. Increased wettability of the material with respect to a sensory enhancing agent or a liquid composition comprising the sensory enhancing agent can result in more rapid and greater distribution of the sensory enhancing agent in the filter material, which can provide an increase in the surface area on the material where the mainstream smoke can take up the sensory enhancing agent and carry it along to the consumer.

The filter material can be treated to increase the difference between the surface tension of a liquid (for example, a sensory enhancing agent and liquid carrier of core of breakable capsule) and the surface energy of the filter material to result in greater wettability of the filter material by the liquid. Greater wettability will lead to a greater rate of diffusion within and along the filter material from where the capsule releases the sensory enhancing agent, and thus an increase in concentration and rate of delivery of the sensory enhancing agent in smoke. Preferably, the surface energy of the treated filter material is greater than that of the liquid by about 2 mN/m to about 10 mN/m.

The filter material may be treated in any suitable manner to enhance uptake of a sensory enhancing agent in mainstream smoke following breaking of a capsule containing the sensory enhancing agent. In preferred embodiments, at least a portion of the filter material is plasma treated to enhance uptake of the sensory enhancing agent in mainstream smoke.

Plasma treatment can increase surface energy of the filter material, which can increase wettability of the filter material. The filter material can be treated with plasma in any suitable manner. For example, the filter material can be corona plasma-treated, atmospheric plasma-treated, or flame plasma-treated. Any suitable gas can be used for plasma treatment. Examples of suitable gases include air, oxygen, nitrogen, water vapor, an inert gas such as argon or helium, a mixture of inert gas and oxygen, a mixture of nitrogen and oxygen, a mixture of helium and oxygen and a mixture of argon and oxygen. The intensity or duration of plasma treatment can be adjusted to provide desired enhancements in wettability. The plasmas described herein can be generated by employing an electric field, including DC glow discharges, either operated continuously (CW) or pulsed, capacitively- and inductively-coupled radio frequency (RF) discharges, helicon discharges, and microwave discharges.

In preferred embodiments, the filter material includes fibers or bundles of fibers in the form of a tow band where the fibers or tow band are treated with plasma by corona discharge. Preferably, the fibers or tow band are treated with plasma by a continuous process in the production line. In preferred embodiments, the fibers or tow bands are plasma treated in a continuous process at a discharge dosage of 20 $W/min/m^2$ or greater, up to about 60 $W/min/m^2$, such as at least about 30 $W/min/m^2$. The treatment intensity can also be adjusted according to the speed of movement of the fibers or tow band in a continuous process. There is generally a positive correlation between treatment power and surface energy of the treated material. Many treatment system are known in the art and can be used to treat the filter material, such as but not limited to the corona treatment systems supplied by Me.ro SpA (Lucca, Italy). Typically, a corona treatment system comprises a treater that applies the power through an air gap via a pair of electrodes, one at a high potential and one connected to the support for the material at ground potential.

The filter material can be treated to achieve any suitable surface energy to enhance wettability of the fibers by the sensory enhancing agent or a liquid carrier containing the sensory agent. In some embodiments, the filter material is treated to have a surface energy of 50 mN/m or greater; more preferably, 60 mN/m or greater; even more preferably between 65 mN/m and 75 mN/m. In some embodiments, the surface energy of the filter material remains elevated at greater than or about 48 mN/m after storage for 6 weeks under standard laboratory conditions.

Various methods well known in the art are available to measure wettability of plasma-treated filter material (Zisman 1964, in Contact Angle, Wettability and Adhesion: Fawkes F; Advances in Chemistry, American Chemical Society, Washington D.C., pp 1-51; K. L. Mittal, 1993, "Contact Angle, Wettability and Adhesion, American Chemical Society, Division of Colloid Surface Chemistry, VSP, Utrecht, The Netherland). For example, one method involves placing a drop of liquid, preferably a drop of liquid from the core of a breakable capsule, on a treated surface of the filter material and measure a contact angle of the drop, commonly via an optical technique. The lower the contact angle of the drop, the better the wettability. Preferably, the contact angle of liquid from the core of a breakable capsule used, or to be used, with the treated filter material is less than that angle formed between the drop and an untreated surface. Another applicable method (J. M. van Hazendonk et al. Colloids and Surfaces A: Physiochemical and Engineering Aspects 81 (1993) pp 251-261) involves a floating test whereby pieces of filter materials are placed on top of liquids of various known surface tension values at 20° C., the surface tension (mN/m) at which the fibrous materials remain just floating were determined. The surface tension of the liquids can be adjusted by using mixtures of solvents (polar or non-polar), e.g., polar solvents such as water and methanol for the range from 23 to 72 mN/m, or non-polar solvents: 1-methylnapthalene and octane for the range from 22 to 38 mN/m. The measured surface tension of the fibers is the surface tension of the liquid at which 50% of the fibers floated on the surface.

A filter may include treated filter material and one or more optional binding agents. Preferably, a filter that includes a binding agent comprises polymeric fibers. The binding agent can bind the polymeric fibers together. Preferably, the binding agent, if included, is a plasticizer. As used herein, a "plasticizer" is a solvent, that when applied to polymeric fibers, solvent-bonds the fibers together. Examples of plasticizers include triacetin (also known as glycerol triacetate), diethylene glycol diacetate, triethylene glycol diacetate, tripropion, acetyl triethyl citrate, triethyl citrate and mixtures of one or more thereof. One or more plasticizers may be mixed with, for example, polyethylene glycol and contacted with the polymeric fibers to solvent-bond the fibers together. The fibers may be contacted with a binding agent in any suitable manner. Preferably, a composition comprising the binding agent is sprayed on the polymeric fibers.

Surface energy or contact angle measurements of treated filter material can be determined before or after one or more binding agents are added to the filter material. In some embodiments, surface energy of contact angle of filter material removed from a smoking article, which may include one or more binding agents, can be measured. The surface energy of such filter material is preferably 50 mN/m or greater; more preferably, 60 mN/m or greater; even more preferably between 65 mN/m and 75 mN/m. Such a range of surface energy can be provided by using a power source capable of generating 30 W/min/m$^2$. For example, the surface energy of cellulose acetate is equivalent to about 38 mN/m with respect to water and glycerin at 20° C. where the contact angle is at 54.4; and after treatment, the surface energy can be increased from about 38 mN/m up to about 70 nM/m. The surface energy of the material after treatment can be at about 42 mN/m, about 45 mN/m, about 47 mN/m, about 50 mM/m, about 57 mN/m, about 63 nM/m, about 66 mN/m, or about 70 nM/m. Other fibers that can be used in a filter, such as untreated cellulosic fibers (44 mN/m); hemp (32.8 mN/m), and flax (36 mN/m) are within the same range. Polyethylene fibers can have its surface energy increased from 32 mN/m to 69 mN/m with a treatment power of 30 W/min/m$^2$. The skilled person will understand that slightly different absolute values may be obtained where different methods of measurement are applied, a test of the treated material can therefore be conducted using the same methodology to measure a relative difference between the untreated and treated samples (with binding agent or without binding agent). Accordingly, it is contemplated that after treatment of the filter material, the surface energy of the filter material can be increased by about 10%, by about 20%, by about 25%, by about 33%, by about 50%, by about 66%, by about 75%, or by about 100%, relative to the untreated material.

Regardless of the surface energy of the treated filter material, the filter material in smoking articles of the present invention, relative to filter material in currently available smoking articles, increases the rate or amount of a sensory enhancing agent entrained in mainstream smoke under standard ISO smoking procedures (such as ISO3308:2012) when a capsule comprising the sensory enhancing agent is ruptured such that the sensory enhancing agent contacts the filter material. To determine whether a smoking article of the present invention increases the rate or amount of a sensory enhancing agent delivered in mainstream smoke, the amount of the sensory agent in mainstream smoke can be compared to a similar smoking article having standard filter material. Preferably, the smoking article of the present invention and the smoking article having the standard filter material are substantially the same except for the filter material employed. For example the breakable capsule, smokable material and construction of the smoking article preferably are as similar as possible. The weight of the filter material employed in a smoking article according to the present invention and in a smoking article having the standard filter against which it is compared are preferably substantially the same (for example, within measurement error or within about 5%). In one embodiment, the standard filter material can be provided and tested in the form of a non-plasma treated cellulose acetate filter rod which has the following properties: 108 mm length (typically used for making 4 filters of 27 mm each, a resistance to draw at 370 mm water, 7.6 mm diameter and 2.7Y35,000 (Y shaped cross-section, a denier per filament of 2.7 and a total denier of 35,000). In another embodiment, standard filter material can be provided and tested as a non-plasma treated fiber or a tow band of cellulose acetate for forming a filter rod which has the following properties: 108 mm length (typically used for making 4 filters of 27 mm each, a resistance to draw at 370 mm water, 7.6 mm diameter and 2.7Y35,000 (Y shaped cross-section, a denier per filament of 2.7 and a total denier of 35,000).

In preferred embodiments, the cumulative amount of the sensory enhancing agent in mainstream smoke within two minutes of breaking a capsule containing the sensory enhancing agent is greater in a smoking article according to the present invention than a substantially similar smoking article with the standard filter material when the smoking articles are subjected to standard ISO smoking procedures. Preferably, the cumulative amount of the sensory enhancing agent in mainstream smoke within two minutes of breaking a capsule containing the sensory enhancing agent is at least 10% greater; more preferably at least 15% greater; even more preferably at least 20% or greater; in a smoking article according to the present invention than a substantially similar smoking article with the standard filter material. In some cases, the cumulative amount of sensory enhancing agent in mainstream smoke within two minutes of breaking a capsule containing the sensory enhancing agent is two times or more, or three times or more than the cumulative amount in smoke of the smoking article having the standard filter material.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Referring now to the drawings, in which some aspects of the present invention are illustrated. It will be understood that other aspects not depicted in the drawings fall within the scope and spirit of the present invention. The drawings are schematic drawings and are not necessarily to scale. Like numbers used in the figures refer to like components, steps and the like. However, it will be understood that the use of a number to refer to a component in a given figure is not intended to limit the component in another figure labelled with the same number. In addition, the use of different numbers to refer to components in different figures is not intended to indicate that the different numbered components cannot be the same or similar to other numbered components.

Figure 1:
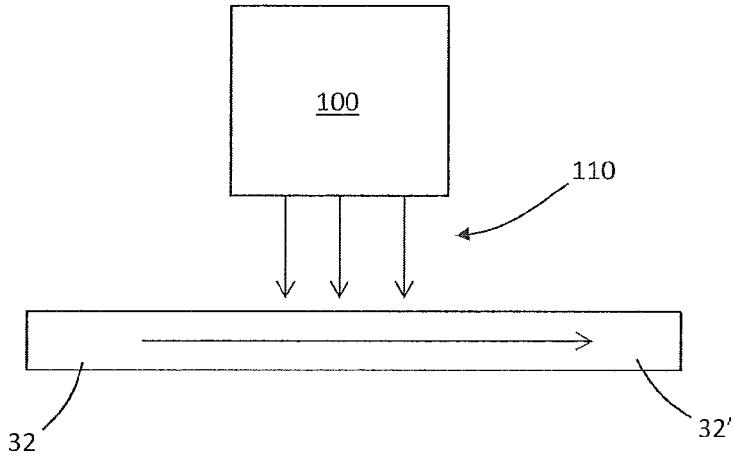
FIG. 1 is a schematic diagram depicting plasma treatment of filter material.

Referring now to FIG. 1, a plasma generator 100 can be used to treat filter material 32 with plasma 110 to increase the effective surface area and wettability of the filter material. In the depicted embodiment, the filter material 32 is moved in the direction indicated by the arrow such that untreated filter material 32 is passed under the plasma discharge 110 resulting in treated filter material 32. The filter material may be in the form of a web of material or, preferably, a band of fiber tow. In embodiments as depicted, the filter material can be treated in a continuous online process. One surface of the filter material can be plasma treated as shown. The opposing major surface of the web or tow band can also be treated.

Figure 2:
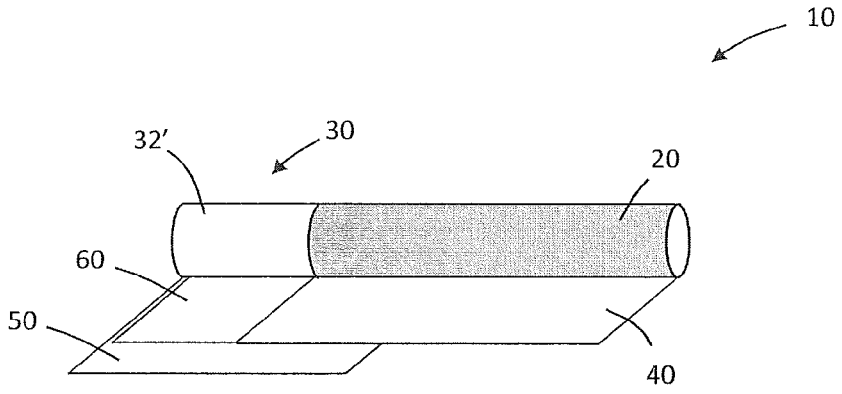
FIG. 2 is a schematic perspective view of a partially unrolled cigarette.

Referring now to FIG. 2, a schematic perspective view of an embodiment of a partially unrolled smoking article 10, in this case a cigarette, is depicted. The smoking article 10 includes a rod of smokable material 20, such as a tobacco rod, and a mouthpiece 30 downstream of the smokable material. The depicted smoking article 10 includes plug wrap 60, cigarette paper 40, and tipping paper 50. In the depicted embodiment, the plug wrap 60 circumscribes at portion of plasma treated filter material 32'. The cigarette paper 40 circumscribes at least a portion of the rod 20. Tipping paper 50 or other suitable wrapper circumscribes the plug wrap 60 and a portion of the cigarette paper 40 as is generally known in the art. The mouthpiece 30 includes a breakable capsule (not shown in FIG. 2), which may be oriented as depicted in, for example, FIGS. 3-4.

Figure 3:
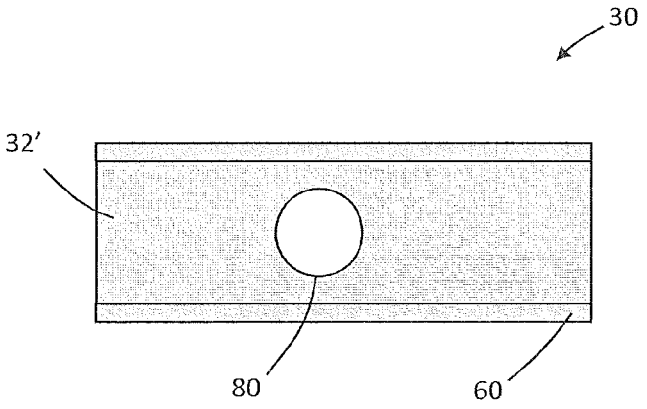
FIGS. 3-4 are schematic longitudinal sectional views of embodiments of mouthpieces for smoking articles that include treated filter material and a breakable capsule.

Referring now to FIG. 3, the depicted mouthpiece 30 includes plug wrap 60 that circumscribes treated filter material 32, which surrounds breakable capsule 80.

Figure 4:
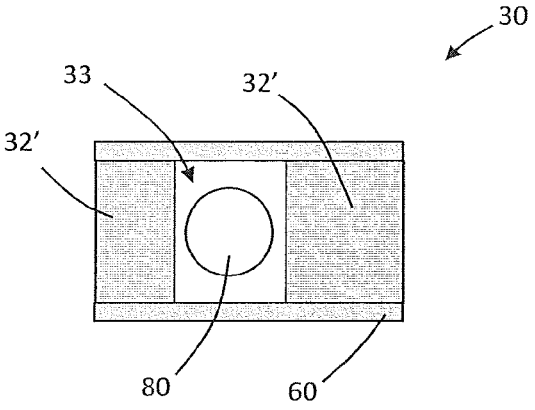

Referring now to FIG. 4, the depicted mouth piece includes a plug wrap 60 that circumscribes treated filter segments 32', which are oriented in a plug-space-plug configuration. Breakable capsule 80 is disposed in space 33.

An example of the enhanced uptake of a composition that can carry flavour or fragrance by a plasma-treated filter material is set out below.

Two types of regular cigarette filters, named 1802 and 0540 are used in the experiment. The filters having the same circumference (24.3 mm) and length (108 mm) were cut longitudinally through the tipping paper and plug wrap once to reveal the filter material. The material used in the 0540 filter contains cellulose acetate tow at denier filament and total denier of 2.7Y35,000. The filter material used in the 1802 filter contains polylactic acid tow at denier filament and total denier of 3.2Y50,000. Both sets of filaments have a Y-shaped cross-section. The cut filters were exposed to plasma in a chamber for surface activation made by Plasma Etch Inc. (Nevada, USA). The settings of the plasma treatment were: low pressure at 200 mbar under argon gas, power setting at 50 W, frequency at 13.56 MHz, and 2 minutes treatment.

Figure 5A:
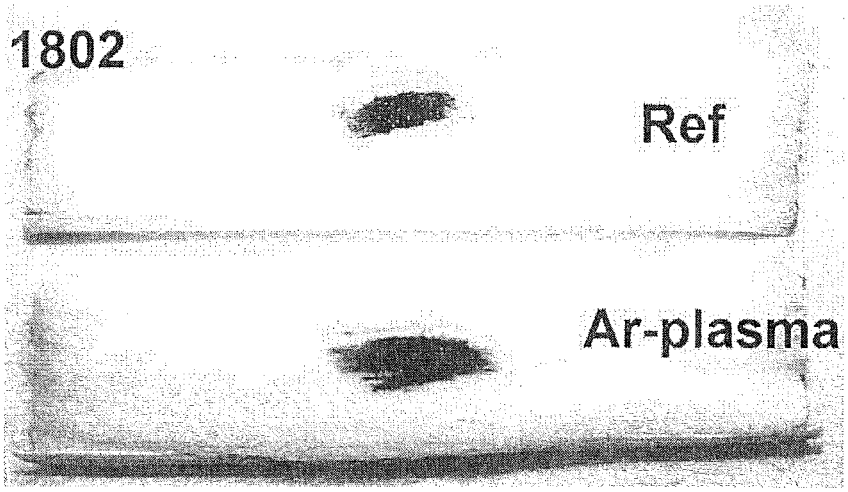
FIGS. 5A and 5B are photographs of untreated and plasma-treated filter material after contact with an oily composition.
Figure 5B:
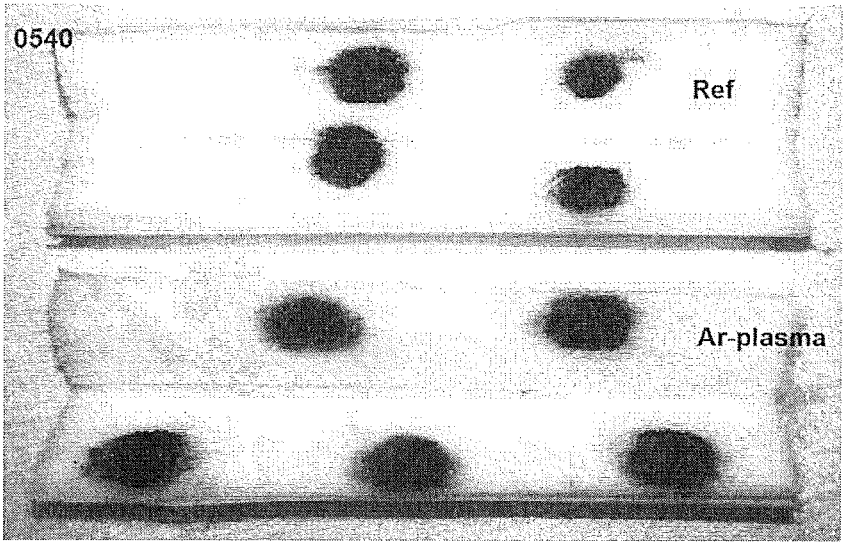

The surface properties of the plasma-treated filter material was assessed by the distribution of a liquid composition comprising 30 ml of coconut oil and 20 microgram of the food colouring E132, also known as indigo carmine. Sensory enhancing agents such as fragrance and flavours are commonly dissolved in and/or carried by an oily liquid composition, such as coconut oil. The same volume of 20 microlitres of the liquid composition is placed onto the exposed filtration material. An increase in the area of blue staining of the filter by the composition is an indication of an improved penetration and absorption of the composition. Taken about 5 seconds after the drop is placed onto the filter, the photograph of FIG. 5A shows the difference between an untreated reference 1802 filter and an argon plasma-treated 1802 filter when the oily composition contacted the filter material; the photograph of FIG. 5B shows the difference between an untreated reference 0504 filter and an argon plasma-treated 0504 filter when the oily composition contacted the filter material. In both types of filtration material, the staining is about 20% to 40% more widespread in plasma-treated samples than the reference samples. The conclusion is that plasma treatment of filter material made with typical substances, such as cellulose acetate or polylactic acid, can increase the distribution of sensory enhancing agent in the filter. For example, the penetration, absorption, or penetration and absorption of the sensory enhancing agent in the filter may be increased.

Accordingly, it is shown that the distribution of a sensory enhancing agent in an oily liquid composition by a cigarette filter treated by plasma under argon, can be increased relative to an untreated filter by at least 10%, at least 20%, at least 30% or at least 40% or 10% to 20%, 10% to 30%, 20% to 40%, 30% to 40% as measured by the area of penetration and absorption of the agent in the filter in a method similar to the above-described example.

Thus, methods, systems, devices, compounds and compositions for PLASMA TREATMENT OF FILTRATION MEDIA FOR SMOKING ARTICLES are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in cigarette manufacturing or related fields are intended to be within the scope of the following claims.

The invention claimed is:

1. A smoking article comprising:

smokable material;

a filter downstream of the smokable material, the filter comprising plasma-treated filter material; and a breakable capsule comprising a core surrounded by a frangible shell, wherein the core comprises a liquid composition comprising a sensory-enhancing agent, wherein the breakable capsule is positioned to cause the liquid composition to contact the filter material when the shell is ruptured, and wherein distribution of the sensory-enhancing agent in the filter material is increased by at least 10% relative to filter material that is not plasma treated.

2. The smoking article of claim 1, wherein the plasma-treated filter material has a surface energy at least about 20% greater than untreated filter material.

3. The smoking article of claim 1, wherein the liquid composition comprises one or more lipids.

4. The smoking article of claim 1, wherein the filter material is treated with plasma by radio frequency discharge at a discharge dosage of at least 30 W/min/$m^2$.

5. The smoking article of claim 1, wherein the distribution of the liquid composition in the filter material is increased at least 10% relative to untreated filter material when the shell is ruptured.

6. The smoking article of claim 1, wherein when the smoking article is subjected to ISO 3308 (2102) smoking procedure a cumulative amount of the sensory enhancing agent delivered in smoke within two minutes of breaking the capsule is at least 10% more than a cumulative amount of a sensory enhancing agent of a substantially similar smoking article having untreated filter material.

7. The smoking article of claim 1, wherein when the smoking article is subjected to ISO 3308 (2102) smoking procedure a cumulative amount of the sensory enhancing agent delivered in smoke within two minutes of breaking the capsule is at least 20% more than a cumulative amount of a sensory enhancing agent of a substantially similar smoking article having untreated filter material.

8. The smoking article of claim 1, wherein the filter material comprises cellulose acetate.

9. The smoking article of claim 8, wherein the plasma-treated filter material comprising cellulose acetate has a surface energy of 50 mN/m or greater.

10. The smoking article of claim 8, wherein the plasma-treated filter material comprising cellulose acetate comprises fibers having a thickness in a range from 1.5 to 8.0 denier per filament.

11. The smoking article of claim 1, wherein the filter material comprises polylactic acid.

12. The smoking article of claim 1, wherein the smokable material comprises tobacco.

* * * * *